United States Patent [19]

Sugisawa et al.

[11] Patent Number: 4,622,446

[45] Date of Patent: Nov. 11, 1986

[54] MICROWAVE DRYING APPARATUS AND USE THEREOF

[75] Inventors: Ko Sugisawa; Yasushi Matsumura, both of Nara; Kazumitsu Taga, Neyagawa; Ryuichi Hattori, Kyoto, all of Japan

[73] Assignee: House Food Industrial Company Ltd., Osaka, Japan

[21] Appl. No.: 559,781

[22] Filed: Dec. 9, 1983

[30] Foreign Application Priority Data

Dec. 9, 1982 [JP] Japan ..... 57-186730[U]

[51] Int. Cl.[4] ..... H05B 6/64

[52] U.S. Cl. ..... 219/10.55 R; 219/10.55 A; 219/10.81; 34/1

[58] Field of Search ..... 219/10.55 A, 10.55 R, 219/10.55 M, 10.81, 10.55 E; 34/1

[56] References Cited

U.S. PATENT DOCUMENTS

| | | | |
|---|---|---|---|
| 2,592,691 | 4/1952 | Hart | 219/10.81 |
| 2,859,534 | 11/1958 | Copson | 34/1 |
| 3,048,928 | 8/1962 | Copson et al. | 34/1 |
| 3,235,971 | 2/1966 | Tooby | 34/1 |
| 3,276,138 | 10/1966 | Fritz | 34/1 |
| 4,310,747 | 1/1982 | Rice et al. | 219/10.55 E X |
| 4,334,136 | 6/1982 | Mahan et al. | 219/10.55 B |
| 4,356,640 | 11/1982 | Jansson | 34/1 |

*Primary Examiner*—Clarence L. Albritton
*Assistant Examiner*—M. M. Lateef
*Attorney, Agent, or Firm*—Harry M. Weiss & Associates

[57] ABSTRACT

An improved microwave drying apparatus comprising a drying chamber provided with a microwave generator and a layer of a weak dielectric substance laminated on at least a part of the inner surface of the wall of the chamber is provided, whereby the occurrence of moisture condensation on the inner wall of the chamber during the drying procedure can be prevented.

65 Claims, 3 Drawing Figures

MICROWAVE DRYING APPARATUS AND USE THEREOF

BACKGROUND OF THE INVENTION

The present invention relates to an improved microwave drying apparatus, more particularly to a microwave drying apparatus free from moisture condensation in the apparatus during drying procedure.

As apparatuses for drying materials, various kinds of apparatuses have been designed or developed heretofore. Among them, the microwave drying apparatus is well known. However, if the materials to be treated are dried by using such a microwave drying apparatus, moisture condensation on the inner wall of the drying chamber is caused due to the generation of water vapor evaporated from the materials being dried. As a result, the water drops formed on the inner wall fall down onto the materials and it becomes difficult to obtain materials uniformly dried and the quality of the dried materials is also degraded. Furthermore, the energy of the microwaves is consumed by condensed water, and therefore, the effectiveness of the drying operation is highly reduced.

Although such a problem is encountered even when the drying operation is carried out under the normal pressure condition, it is even more significant when the drying operation is effected at a reduced pressure condition because the drying of the materials is carried out in a completely sealed drying chamber.

In order to prevent the occurrence of moisture condensation, a reduced pressure microwave drying apparatus has been developed and practically used, in which the wall of the drying chamber is heated by a heater. However, in this apparatus, it is innevitable to use microwaves to dry materials and to use a heater to prevent the occurrence of moisture condensation on the inner wall of the drying chamber, that is, it is necessary to use two different heat sources.

BRIEF DESCRIPTION OF THE INVENTION

Under such circumstances, the inventors have exhaustively investigated ways to overcome such disadvantages of the prior art, and as a result have found that the occurrence of moisture condensation on the inner wall of the drying chamber can be prevented by applying or depositing a special substance on the inner wall. The invention is based on such finding.

The principal object of this invention is to provide a microwave drying apparatus free from moisture condensation on the inner wall of a drying chamber, without using any heat source other than microwaves.

Another object of this invention is to provide a dried material having excellent quality.

The said and other objects of this invention may be accomplished by utilizing a weak dielectric substance which generates heat when microwaves are applied thereto.

DETAILED EXPLANATION OF THE INVENTION

The microwave drying apparatus of this invention comprises a drying chamber, a microwave generator and a means for evacuation, and the improvement is characterized in that a weak dielectric substance is applied or deposited onto at least a part of the inner wall of the drying chamber, whereby the occurrence of moisture condensation in the drying chamber is prevented and the quality of the materials can also be improved.

The weak dielectric substance as used herein has a half power depth of about 0.1 m to about 5 m, preferably about 0.5 m to about 3 m and as typical examples thereof there can be mentioned, for example, ceramic, synthetic resin such as fluoroplastic, phenolic resin, silicone resin, nylon, epoxy resin, acrylic acid resin or the like, alumina, alumina porcelain, talc porcelain and a mixture thereof; the above material in which carbon is contained; and carbon fiber. Among these, the material in which carbon is contained and the carbon fiber can suitably be used to obtain particularly good results. The carbon can be contained in the above material in the form of a rod, plate or powder. The carbon-containing material can be applied, for example, in the form of a ceramic plate which is obtained by incorporating carbon powder into ceramic, a silicone resin plate which is obtained by sandwiching a carbon plate between silicone resin plates and a fluoroplastic tray which is obtained by placing a carbon rod in fluoroplastic material.

The amount of the weak dielectric substance applied (thickness) is not critical, and it can practically be applied in a thickness of about 5 mm to about 20 mm.

Preferred embodiments of the microwave drying apparatus according to the present invention, given by way of non-limitative example only, are now described with reference to the accompanying drawings.

Figure 1:
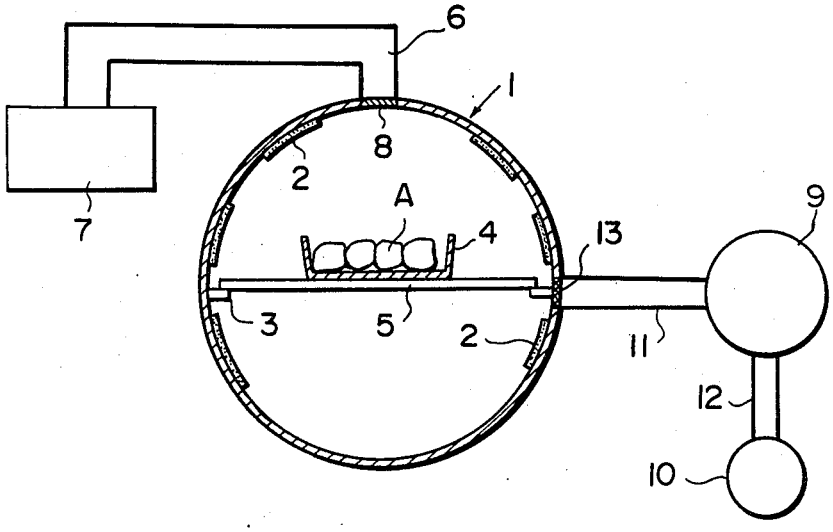
FIG. 1 is an illustrative diagram of the reduced pressure microwave drying apparatus as an embodiment of this invention.
Figure 2:
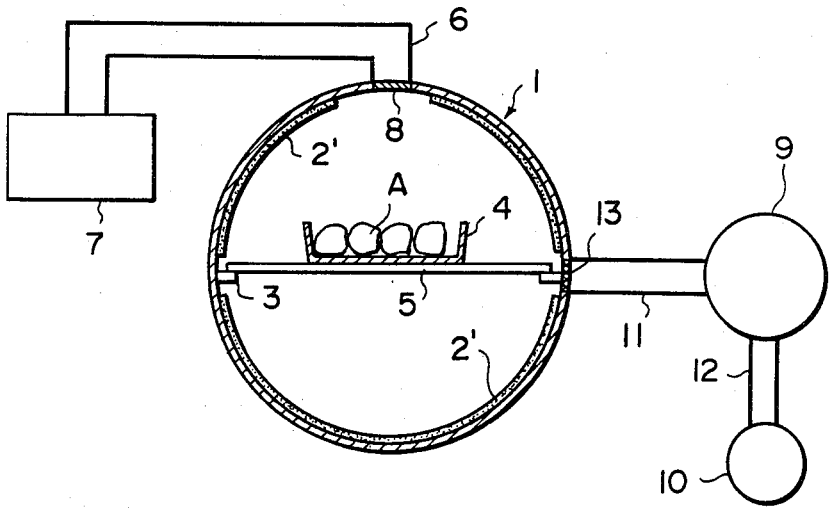
FIG. 2 is an illustrative drawing of another embodiment of the drying apparatus according to the present invention.

In the figures, reference numeral 1 represents a drying chamber, on the inner wall of which a weak dielectric material is applied or deposited. In this respect, the weak dielectric material may be applied or deposited on a part of the wall as shown in FIG. 1 (reference numeral 2) or on the whole inner wall as shown in FIG. 2 (reference numeral 2').

The weak dielectric material 2 or 2' is characterized by the fact that it generates heat when microwave radiation is applied to it. Thus, the moisture condensation on the inner wall of the drying chamber 1, during the drying operation, can effectively be prevented.

The weak dielectric substance may advantageously be applied or deposited on the inner wall by using it on a portion where moisture condensation is liable to occur or using a relatively high dielectric substance as the substance 2 and it may be advantageous to form the drying chamber 1 from a relatively high heat conductive material such as aluminium, aluminium alloy, magnesium alloy or the like, when it is partially applied. In particular, in the latter case, the heat generated when the weak dielectric substance 2 is exposed to microwave radiation is transferred to the whole drying chamber 1 to heat it and this results in the same degree of anti-moisture condensation effect as in the case where the weak dielectric substance 2' is applied on the whole inner surface of the chamber 1 (FIG. 2).

In addition, the heat generated by the weak dielectric substance 2 or 2' may be utilized as radiant heat for drying material A to be treated.

The drying chamber 1 is equipped with a supporting means 3 on the inner wall thereof for the purpose of holding shelves 5 for material A per se or a container 4 containing materials A to be treated. In this case, it is desirable that the weak dielectric substance such as disclosed above be applied on or embedded in the container 4 and/or the shelf 5, otherwise the container 4 and/or the shelf 5 per se are formed with at least one of the weak dielectric materials. Thus, during the drying operation of materials, the container 4 and/or the shelf 5 per se are heated by the application of microwave radiation and the use of the heat thus generated makes it possible to increase the drying efficiency of the apparatus.

The supporting means used herein may be any of the conventional means such as an annular rim, a plurality of protrusions, wire guide or the like.

The drying chamber 1 is connected to a microwave oscillator 7 through a waveguide 6. The portion 8 of the drying chamber 1 connected to the waveguide 6, which corresponds to at most the diameter of the cross-section of the waveguide 6, is constructed from a gas-impermeable and microwave-permeable material such as quartz, ceramics, polystyrene, aluminous porcelain, calcium fluoride, fluorine-containing polymers or the like. The drying chamber is further connected to a vacuum pump 10 through exhaust pipes 11, 12 and a cold trap 9 placed therebetween, to reduce the pressure in the chamber to a desired degree of vacuum. The portion of the chamber 1 connected to the exhaust pipe 11, which corresponds to at most the diameter of the cross-section of the pipe 11, is provided with a panting plate or wire gauze 13 which is permeable to gases but impermeable to microwaves, whereby gases in the chamber 1 surely pass the plate or wire gauze to go out of the drying chamber, through the exhaust pipe 11, while microwaves are completely prevented from passing through the plate or wire gauze 13.

The "panting plate" and "wire gauze" used herein are constructed from aluminium, stainless steel, steel, light alloy or the like.

One embodiment of the drying apparatus according to the invention is constructed as described above. However, as the above mentioned exhaust means, it is also possible to use a water sealable vacuum pump and/or a steam ejector and thus to eliminate the need for a cold trap. Furthermore, the drying apparatus according to the invention can be constructd so as to carry out the drying operation under the normal pressure condition.

Figure 3:
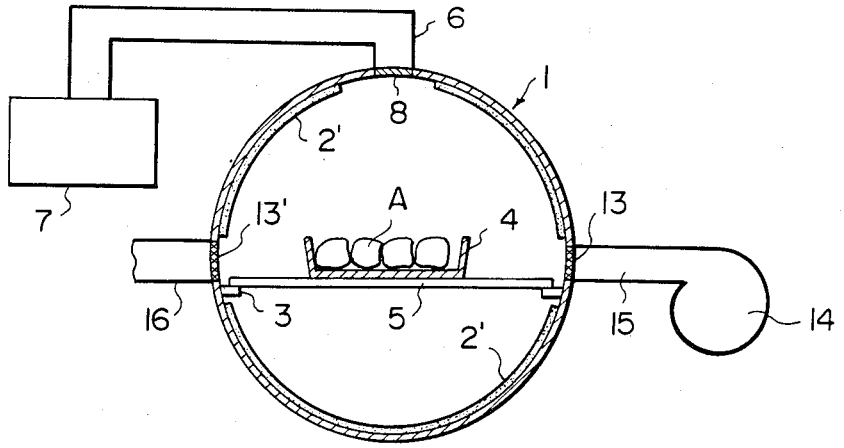
FIG. 3 is an illustrative drawing of another embodiment of the normal pressure drying apparatus according to the present invention.

For example, the drying chamber 1 of the normal pressure microwave drying apparatus as shown in FIG. 3 is equipped with a blower 14 and a pipe 15 serving as an air duct in place of the vacuum pump 10, the cold trap 9 and the exhaust pipes 11 and 12 as shown in FIGS. 1 and 2, and an exhaust pipe 16 for extracting water vapor. The portions of the chamber 1 connected to the air duct pipe 15 and the exhaust pipe 16 are provided with panting plates or wire gauze 13 and 13', respectively, whereby gases in the drying chamber pass by the plates and leave the chamber and microwaves are prevented from passing beyond the plates.

The drying apparatus according to the present invention may be used in the following manner (FIG. 1): A material A to be treated is charged in a container 4 and the container 4 is placed on the shelf 5 in the chamber 1. Then, the pressure in the chamber 1 is adjusted to a desired degree of vacuum by the vacuum pump 10 before applying microwaves from the microwave oscillator 7 to the material A through the waveguide 6. The energy of applied microwaves is used to dry the material A and to heat the weak dielectric substance 2 applied on the inner wall of the chamber 1. As the drying of the material A proceeds, the moisutre contained in the material A is evaporated. However, the water vapour can easily be extracted from the chamber 1 through the exhaust pipe 11 and condensed in the cold trap 9 without occurrence of moisture condensation on the inner wall of the chamber, since the weak dielectric substance 2 is heated by the application of microwave radiation.

In the above embodiment, a reduced pressure microwave drying apparatus is illustrated. However, the technical idea according to the present invention is applicable to any type of microwave drying apparatus. Namely, according to the present invention, the same effects as mentioned above can be accomplished by applying a weak dielectric substance on the inner wall of the drying chamber irrespective of the type of microwave drying apparatus.

As the material A to be dried according to the present invention, there may be mentioned, for instance, fruit, vegetable, meat and other foodstuff.

Thus, according to the present invention, moisture condensation on the inner wall of the drying chamber due to the water vapor evaporated from the dried material can effectively be prevented and as a result uniform dehydration of the material can be attained. In addition, the reduction in dehydration efficiency due to the absorption of microwave energy by condensed water can also be prevented. Furthermore, the thermal energy generated by the weak dielectric substance heated by the application of microwave radiation can be utilized to dry materials and thereby the dehydration efficiency can further be improved. These effects can be accomplished simply by using microwaves as the heat source, according to the present invention. This is an important merit of this invention.

The above descripton is given by way of example only. Changes in form and detail may be made by one skilled in the art without departing from the scope of the invention as defined by the appended claims.

We claim:

1. A reduced pressure microwave drying apparatus comprising a drying chamber for drying a material to be treated, a microwave oscillator, a waveguide and an exhaust means, said drying chamber having a weak dielectric substance applied onto at least part of the inner wall thereof, said waveguide being connected to the microwave oscillator at one end thereof and to a portion of the wall of the drying chamber at the opposite end which is composed of gas-impermeable and microwave-permeable material whereby microwaves are guided into the drying chamber, a part of guided microwaves are directly applied to the material to be treated and the remainder of guided microwaves are applied to the inner wall of the drying chamber, said exhaust means being a vacuum pump system comprising a cold trap and a vacuum pump.

2. A microwave drying apparatus as set forth in claim 1, wherein said weak dielectric substance has a half power depth of about 0.1 m to about 5 m.

3. A microwave drying apparatus as set forth in claim 2, wherein said weak dielectric substance is at least one of a ceramic material, synthetic resin material, alumina material, alumina procelain material and talc porcelain material.

4. A microwave drying apparatus as set forth in claim 3, wherein said weak dielectrical substance is at least one of said weak dielectric substance materials, said materials containing carbon.

5. A microwave drying apparatus as set forth in claim 2, wherein said weak dielectrical substance is a carbon fiber.

6. A microwave drying apparatus as set forth in claim 3, wherein said synthetic resin material is one of a fluoroplastic material, phenolic resin material, silicone resin material, nylon material, epoxy resin material and acrylic acid resin material.

7. A microwave drying apparatus as set forth in claim 4, wherein said synthetic resin material is one of a fluoroplastic material, phenolic resin material, silicone resin material, nylon material, epoxy resin material and acrylic acid resin material.

8. A microwave drying apparatus as set forth in claim 1, wherein said exhaust means is at least one of a steam ejector and a water sealable vacuum pump.

9. A microwave drying apparatus as set forth in claim 1, wherein said exhaust means is a normal pressure system.

10. A microwave drying apparatus as set forth in claim 1, wherein the connection portion of said drying chamber and said exhaust means is constructed such that gases leave the chamber and microwaves are prevented from leaving the chamber.

11. A microwave drying apparatus as set forth in claim 1, wherein the connection portion of said drying chamber and said exhaust means is constructed such that gases leave the chamber and microwaves are prevented from leaving the chamber.

12. A microwave drying apparatus as set forth in claim 8, wherein the connecting portion of said drying chamber and said exhaust means is constructed such that gases leave the chamber and microwaves are prevented from leaving the chamber.

13. A microwave drying apparatus as set forth in claim 9, wherein the connecting portion of said drying chamber and said exhaust means is constructed such that gases leave the chamber and microwaves are prevented from leaving the chamber.

14. A microwave drying apparatus as set forth in claim 10, wherein said connection portion is one of a panting plate and a wire gauze.

15. A microwave drying apparatus as set forth in claim 11, wherein said connecting portion is one of a panting plate and a wire gauze.

16. A microwave drying apparatus as set forth in claim 12, wherein said connection portion is one of a panting plate and a wire gauze.

17. A microwave drying apparatus as set forth in claim 13, wherein said connection portion is one of a panting plate and a wire gauze.

18. A microwave drying apparatus as set forth in claim 14, wherein said connecting portion is composed of a gas-permeable and microwave-impermeable material, said material being one of an aluminum material, stainless steel material, steel material and light alloy material.

19. A microwave drying apparatus as set forth in claim 15, wherein said connecting portion is composed of a gas-permeable and microwave-impermeable material, said material being one of an aluminum material, stainless steel material, steel material and light alloy material.

20. A microwave drying apparatus as set forth in claim 16, wherein said connecting portion is composed of a gas-permeable and microwave-impermeable material, said material being one of an aluminum material, stainless steel material, steel material and light alloy material.

21. A microwave drying apparatus as set forth in claim 17, wherein said connecting portion is composed of a gas-permeable and microwave-impermeable material, said material being one of an aluminum material, stainless steel material, steel material and light alloy material.

22. A microwave drying apparatus as set forth in claim 1, wherein said drying chamber is further provided at the wall thereof with a connecting portion composed of gas-impermeable and microwave-permeable material and connected to a waveguide.

23. A microwave drying apparatus as set forth in claim 19, wherein said drying chamber is further provided at the wall thereof with a connecting portion composed of gas-impermeable and microwave-permeable material and connected to a waveguide.

24. A microwave drying apparatus as set forth in claim 20, wherein said drying chamber is further provided at the wall thereof with a connecting portion composed of gas-impermeable and microwave-permeable material and connected to a waveguide.

25. A microwave drying apparatus as set forth in claim 21, wherein said drying chamber is further provided at the wall thereof with a connection portion composed of gas-impermeable and microwave-permeable material and connected to a waveguide.

26. A microwave drying apparatus as set forth in claim 22, wherein said gas-impermeable and microwave-permeable material is one of a quartz material, ceramic material, polystyrene material, aluminous porcelain material, calcium fluoride material and fluorine-containing polymers material.

27. A microwave drying apparatus as set forth in claim 23, wherein said gas-impermeable and microwave-permeable material is one of a quartz material, ceramic material, polystyrene material, aluminous porcelain material, calcium fluoride material and fluorine-containing polymers material.

28. A microwave drying apparatus as set forth in claim 24, wherein said gas-impermeable and microwave-permeable material is one of a quartz material, ceramic material, polystyrene material, aluminous porcelain material, calcium fluoride material and fluorine-containing polymers material.

29. A microwave drying apparatus as set forth in claim 25, wherein said gas-impermeable and microwave-permeable material is one of a quartz material, ceramic material, polystyrene material, aluminous porcelain material, calcium fluoride material and fluorine-containing polymers material.

30. A microwave drying apparatus as set forth in claim 1, wherein said drying chamber is further provided on the inner wall thereof with a supporting means for supporting a shelf for supporting the material being treated.

31. A microwave drying apparatus as set forth in claim 23, wherein said drying chamber is further provided on the inner wall thereof with a supporting means for supporting a shelf for supporting the material being treated.

32. A microwave drying apparatus as set forth in claim 24, wherein said drying chamber is further provided on the inner wall thereof with a supporting means for supporting a shelf for supporting the material being treated.

33. A microwave drying apparatus as set forth in claim 25, wherein said drying chamber is further provided on the inner wall thereof with a supporting means for supporting a shelf for supporting the material being treated.

34. A microwave drying apparatus as set forth in claim 30, wherein said treated material being contained in a container, said container being supported on said shelf.

35. A microwave drying apparatus as set forth in claim 31, wherein said treated material being contained in a container, said container being supported on said shelf.

36. A microwave drying apparatus as set forth in claim 32, wherein said treated material being contained in a container, said container being supported on said shelf.

37. A microwave drying apparatus as set forth in claim 33, wherein said treated material being contained in a container, said container being supported on said shelf.

38. A microwave drying apparatus as set forth in claim 34, wherein said shelf includes one of a weak dielectric substance applied on it, a weak dielectric substance embedded in it, and a weak dielectric substance.

39. A microwave drying apparatus as set forth in claim 35, wherein said shelf includes one of a weak dielectric substance applied on it, a weak dielectric substance embedded in it, and a weak dielectric substance.

40. A microwave drying apparatus as set forth in claim 36, wherein said shelf includes one of a weak dielectric substance applied on it, a weak dielectric substance embedded in it, and a weak dielectric substance.

41. A microwave drying apparatus as set forth in claim 37, wherein said shelf includes one of a weak dielectric substance applied on it, a weak dielectric substance embedded in it, and a weak dielectric substance.

42. A microwave during apparatus as set forth in claim 38, wherein said container includes one of a weak dielectric substance applied on it, a weak dielectric substance embedded in it, and a weak dielectric substance.

43. A microwave drying apparatus as set forth in claim 39, wherein said container includes one of a weak dielectric substance applied on it, a weak dielectric substance embedded in it, and a weak dielectric substance.

44. A microwave drying apparatus as set forth in claim 40, wherein said container includes one of a weak dielectric substance applied on it, a weak dielectric substance embedded in it, and a weak dielectric substance.

45. A microwave drying apparatus as set forth in claim 41, wherein said container includes one of a weak dielectric substance applied on it, a weak dielectric substance embedded in it, and a weak dielectric substance.

46. A microwave drying apparatus as set forth in claim 42, wherein said weak dielectric substance used for said shelf and said container is at least one of a ceramic material, synthetic resin material, alumina material, alumina porcelain material and talc porcelain material.

47. A microwave drying apparatus as set forth in claim 43, wherein said weak dielectric substance used for said shelf and said container is at least one of a ceramin material, synthetic resin material, alumina material, alumina porcelain material, and talc porcelain material.

48. A microwave drying apparatus as set forth in claim 44, wherein said weak dielectric substance used for said shelf and said container is at least one of a ceramic material, synthetic resin material, alumina material, alumina porcelain material, and talc porcelain material.

49. A microwave drying apparatus as set forth in claim 45, wherein said weak dielectric substance used for said shelf and said container is at least one of a ceramic material, synthetic resin material, alumina material, alumina porcelain material, and talc porcelain material.

50. A microwave drying apparatus as set forth in claim 46, wherein said weak dielectric substance used for said shelf and said container is at least one of said weak dielectric substance materials, said materials containing carbon.

51. A microwave drying apparatus as set forth in claim 47, wherein said weak dielectric substance used for said shelf and said container is at least one of said weak dielectric substance materials, said materials containing carbon.

52. A microwave drying apparatus as set forth in claim 48, wherein said weak dielectric substance used for said shelf and said container is at least one of said weak dielectric substance materials, said material containing carbon.

53. A microwave drying apparatus as set forth in claim 49, wherein said weak dielectric substance used for said shelf and said container is at least one of said weak dielectric substance materials, said materials containing carbon.

54. A microwave drying apparatus as set forth in claim 42, wherein said weak dielectric substance used for said shelf and said container is a carbon fiber.

55. A microwave drying apparatus as set forth in claim 43, wherein said weak dielectric substance used for said shelf and said container is a carbon fiber.

56. A microwave drying apparatus as set forth in claim 44, wherein said weak dielectric substance used for said shelf and said container is a carbon fiber.

57. A microwave drying apparatus as set forth in claim 45, wherein said weak dielectric substance used for said shelf and said container is a carbon fiber.

58. A microwave drying apparatus as set forth in claim 46, wherein said synthetic resin material used for said shelf and said container is one of a fluoroplastic material, phenolic resin material, silicone resin material, nylon material, epoxy resin material and acrylic acid resin material.

59. A microwave drying apparatus as set forth in claim 47, wherein said synthetic resin material used for said shelf and said container is one of a fluoroplastic material, phenolic resin material, silicone resin material, nylon material, epoxy resin material and acrylic acid resin material.

60. A microwave drying apparatus as set forth in claim 48, wherein said synthetic resin material used for said shelf and said container is one of a fluoroplastic material, phenolic resin material, silicone resin material, nylon material, epoxy resin material and acrylic acid resin material.

61. A microwave drying apparatus as set forth in claim 49, wherein said synthetic resin material used for said shelf and said container is one of a fluoroplastic material, phenolic resin material, silicone resin material, nylon material, epoxy resin material and acrylic acid resin material.

62. A microwave drying apparatus as set forth in claim 50, wherein said synthetic resin material used for said shelf and said container is one of a fluoroplastic material, phenolic resin material, silicone resin material, nylon material, epoxy resin material and acrylic acid resin material.

63. A microwave drying apparatus as set forth in claim 51, wherein said synthetic resin material used for said shelf and said container is one of a fluoroplastic material, phenolic resin material, silicone resin material, nylon material, epoxy resin material and acrylic acid resin material.

64. A microwave drying apparatus as set forth in claim 52, wherein said synthetic resin material used for said shelf and said container is one of a fluoroplastic material, phenolic resin material, silicone resin material, nylon material, epoxy resin material and acrylic acid resin material.

65. A microwave drying apparatus as set forth in claim 53, wherein said synthetic resin material used for said shelf and said container is one of a fluoroplastic material, phenolic resin material, silicone resin material, nylon material, epoxy resin material and acrylic acid resin material.

* * * * *